US006032588A

United States Patent [19]

Williamson et al.

[11] Patent Number: 6,032,588

[45] Date of Patent: Mar. 7, 2000

[54] CONVERTIBLE TABLE SYSTEM

[75] Inventors: Paul Douglas Williamson, Wellington; Bernard Anton Hiestand; Peter John Wilcock, both of Lower Hutt, all of New Zealand

[73] Assignee: City of Dublin Capital Limited, Dublin, Ireland

[21] Appl. No.: 09/147,286

[22] PCT Filed: Sep. 14, 1998

[86] PCT No.: PCT/NZ98/00137

§ 371 Date: Nov. 20, 1998

§ 102(e) Date: Nov. 20, 1998

[87] PCT Pub. No.: WO99/13753

PCT Pub. Date: Mar. 25, 1999

[30] Foreign Application Priority Data

Sep. 12, 1997 [NZ] New Zealand ..... 328724

[51] Int. Cl.[7] ..... A47B 1/04

[52] U.S. Cl. ..... 108/66; 108/78

[58] Field of Search ..... 108/65, 66, 77, 108/78, 80, 69

[56] References Cited

U.S. PATENT DOCUMENTS

| | | | |
|---|---|---|---|
| 1,490,261 | 4/1924 | Freeman . | |
| 1,571,806 | 2/1926 | Schmitt . | |
| 1,641,495 | 9/1927 | Krick . | |
| 1,641,518 | 9/1927 | Anderson . | |
| 1,662,228 | 3/1928 | Anderson . | |
| 1,695,110 | 12/1928 | Krick . | |
| 1,709,210 | 4/1929 | Gillespie . | |
| 1,735,535 | 11/1929 | Feldman . | |
| 1,781,602 | 11/1930 | Rygl . | |
| 1,993,787 | 3/1935 | Howe | 311/60 |
| 2,452,979 | 11/1948 | Zuckerman | 311/62 |
| 2,907,616 | 10/1959 | Sulliavan | 311/60 |
| 2,933,359 | 4/1960 | Fizdale | 311/60 |
| 3,636,891 | 1/1972 | Bertelsen | 108/66 |
| 4,069,770 | 1/1978 | Bertelsen | 108/66 |
| 4,646,654 | 3/1987 | Sullivan | 108/69 |
| 4,693,187 | 9/1987 | Bisbing | 108/69 |
| 5,513,578 | 5/1996 | Tordsen | 108/77 |
| 5,709,157 | 1/1998 | Hanusiak | 108/78 |

FOREIGN PATENT DOCUMENTS

| | | | |
|---|---|---|---|
| 0170522 | 2/1986 | European Pat. Off. . | |
| 352803 | 4/1961 | Switzerland | 108/66 |
| 789624 | 1/1958 | United Kingdom . | |
| 952420 | 3/1964 | United Kingdom . | |

OTHER PUBLICATIONS

Brochure, The Complete Häfele, Häfele (N.Z. Limited), Company for Furniture Hardware.

*Primary Examiner*—Peter M. Cuomo
*Assistant Examiner*—Gerald A. Anderson
*Attorney, Agent, or Firm*—Jacobson, Price, Holman & Stern PLLC.

[57] ABSTRACT

There is described a convertible table system which has a fixed central portion and leaves along at least two adjacent edges. The leaves fold from an operative position where they are substantially co-planar with the table top to a stored position where they are rotated through 180° to be against or adjacent the bottom of the fixed part of the table. The leaves are retained in the operative position by sliding supports. These supports have pendant portions to be sufficiently robust to withstand the usage to which the table might be put. The pendant portions are able to be retracted out of the paths of the leaves when they are folded to the stored position. The angle of mounting of the sliding supports allows this to occur. The leaves are held in the stored position by a catch which can be magnetic or frictional or other.

18 Claims, 12 Drawing Sheets

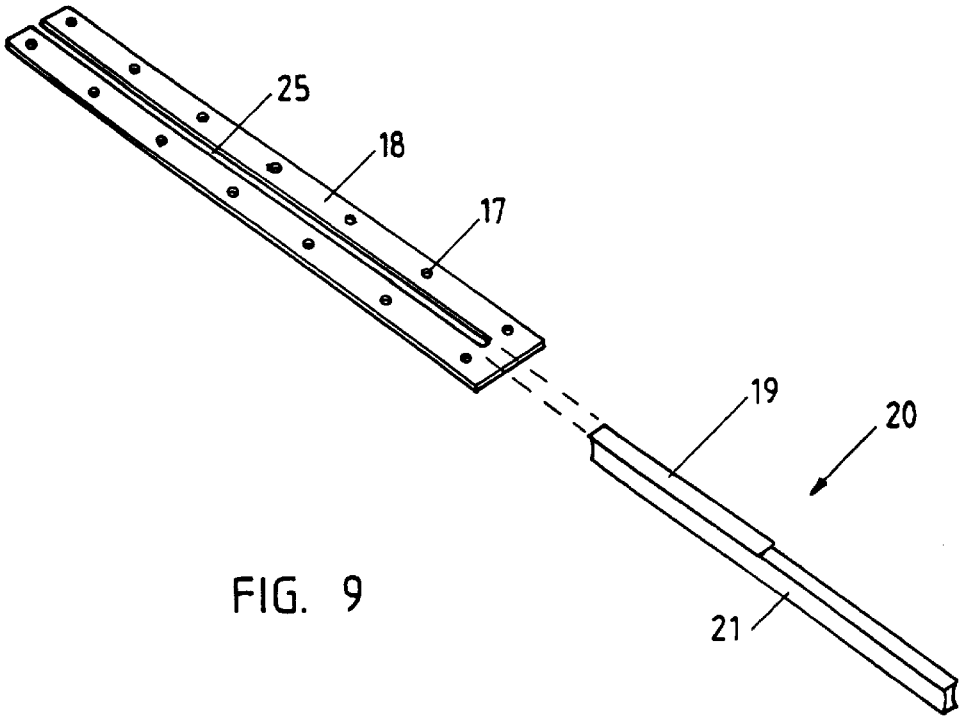
FIG. 9
FIG. 10
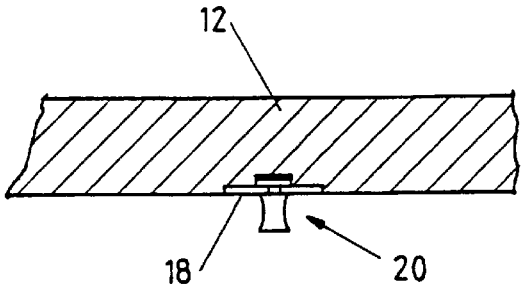
FIG. 10A
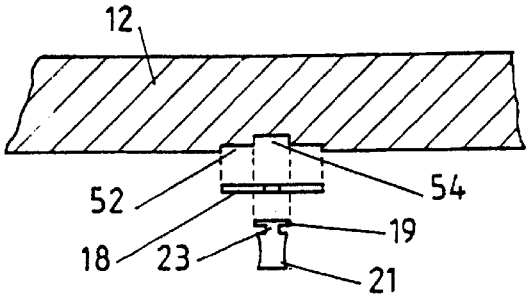

CONVERTIBLE TABLE SYSTEM

TECHNICAL FIELD

This invention relates to a convertible table system having a fixed portion with leaves along at least two adjacent edges able to be folded away under the fixed portion in a manner which does not interfere with the legs of persons seated at the table.

BACKGROUND ART

Convertible tables are well known in the art. Prior art convertible tables can be classified roughly into four categories.

Exemplary of the first category is U.S. Pat. No. 5,513,578. In the invention described the drop leaves either just hang vertically and would be in the way of the legs of persons seated at the table when the leaves are stored.

Included in the second category are U.S. Pat. Nos. 2,933,359; 1,993,787 and 1,781,602. Each of these patents describes a drop leaf table construction with elaborate mechanisms for raising and lowering four leaves at the same time. In each case the raising and lowering mechanisms preclude the leaves being able to be rotated through 180° to rest flush against the bottom of the table. Also, the elaborate mechanism would be expensive to construct in the first place and would require significant maintenance which could be a serious disadvantage if the tables were to be used in a restaurant.

A third category is illustrated by U.S. Pat. Nos. 4,646,654, 2,907,616 and 1,490,261. In each of these patents there is described a complicated hinge mechanism about which the leaves are rotated. In each case the leaf can be rotated substantially through 180°. However, the hinging mechanism lies between the stored leaf and the bottom of the table. The complexity of the hinging mechanism would mean that such inventions would not be cost effective in mass production.

The fourth category of convertible table, which is most similar to the convertible table system of the present invention, is illustrated by U.S. Pat. Nos. 5,709,157; 2,452,979; 1,571,806 and by the drop leaf table with a "Vario" drop leaf table fitting illustrated in the Häfele New Zealand catalogue on page 6.19. In each of these cases the drop leaf is pivoted on ordinary hinges. In U.S. Pat. No. 2,452,979 each drop leaf is held in an elevated position by a rotating detent 20. In the other three patent specifications the leaf is held in an elevated position by a sliding support member which slides beyond the edge of the table to support the leaf in the operative position and retracts to be substantially at or adjacent the edge in the stored configuration. When the leaf is retracted it rests against or adjacent the sliding member rather than against the bottom of the table top. In each case the sliding support member is at right angles to the common edge of the leaf and table.

Where convertible tables are used in the restaurant trade it is important that they be quickly and easily convertible from one mode to the other. It goes without saying that they must also be robust to be able to withstand the forces exerted as leaves are being raised or lowered and also that the weight of diners resting their elbows on the table is also supportable. Tables will sometimes be lifted and carried by the edges of the raised leaves and the forces involved must also be taken into account. When using the mechanism for retaining the leaves in the elevated position the combination of hinges and a sliding support is a convenient means of providing sufficient strength. The sliding support should have a reinforcing portion extending vertically downwardly. While this provides the robustness it is also necessary that the portion of the sliding support extending downwardly is able to be retracted out of the way of the leaves for folding them up flush against the bottom of the table.

Accordingly, it is an object of this invention to go some way towards avoiding the disadvantages and achieving the desideratum described above or at least to offer the public a useful choice.

DISCLOSURE OF INVENTION

For the purposes of this specification the expression "table system" is intended to include not only "tables" as that expression is normally understood but also office furniture such as desks, kitchen benches and movable trolleys and shelving units and any other similar construction where it is desirable to have optional extensions of adjacent sides of operative surfaces.

Accordingly, the invention may be said broadly to consist in a table system (as herein defined) comprising a fixed top portion having at least one pair of adjacent edges, a leaf cooperable with each said edge, etch said leaf being pivotal through substantially 180° from an operative position in which the top surface of said leaf is substantially coplanar with the top surface of said fixed top portion, to a storage portion in which the bottom surface of said leaf rests against or adjacent to the bottom surface of said fixed top portion, support means associated with each said leaf, each said support means comprising a rail member and an associated sliding member, each said rail member being fixed to the bottom of said fixed top portion, a supporting portion of each said sliding member extending downwardly from said rail member, each said sliding member being reciprocally slidable in its said rail member from an operative position in which its supporting portion supports a said leaf in its operative position to its storage position in which no part of said supporting portion is between said leaf and the bottom of said fixed top portion, and means to retain each said leaf in its stored position.

Preferably said rail member is recessed into the bottom of said fixed top portion so that no part of said rail member is between said leaf and the bottom surface of said fixed top portion when said leaf is in the stored position.

Preferably said adjacent sides of said fixed top portion intersect.

Preferably said fixed top portion is square.

In one alternative said table system is a portion of a desk.

In another alternative said table system is the end of a kitchen bench top.

Preferably said leaf in plan view is substantially the segment of a circle.

Preferably said fixed top portion is mounted on single central pedestal.

Alternatively said fixed top portion is mounted on four legs.

Preferably each said leaf is hingedly connected to the edge of said fixed top portion with which it is cooperable.

Preferably said rail member comprises a pair of side members with a gap of therebetween, and said sliding member has a leg and foot portion which are substantially T-shaped in section, said foot section sliding along the upper surfaces of the said side members with said leg being in the gap therebetween, said supporting portion of said sliding member extending in use downwardly from said leg.

Preferably one or other of said rail member and said sliding member are of low friction material.

In one alternative, the means to retain each said leaf in said stored position is a magnetic catch.

In another alternative the means to retain each said leaf in said stored position is a friction catch.

Preferably the longitudinal axis along which each said sliding member slides within its associated rail member is at an angle in the range of 67–71° with its intersection with the edge of the table beyond which it extends.

In one alternative, said angle is 67.5°.

In another alternative, said angle is 70°.

In one alternative there is provided on the bottom of each said leaf a shoe which receives the outward end of its corresponding supporting member to define its limit of travel, there being a corresponding recess in the bottom of said fixed top portion to receive said shoe when said leaf is in it stored position.

Preferably said shoe has flexible flutes on its outer sides and in combination with said recess in the bottom of said fixed portion comprises said friction catch.

The invention may be more fully understood by having reference to the accompanying drawings in which:

FIG. 9 is an exploded view of a rail member and a sliding member according to a first embodiment of the invention.

FIG. 10 is a cross-sectional view of the supporting mechanism shown in FIG. 9 mounted on the bottom of a table.

FIG. 10A is an exploded view of FIG. 10.

Figure 17:
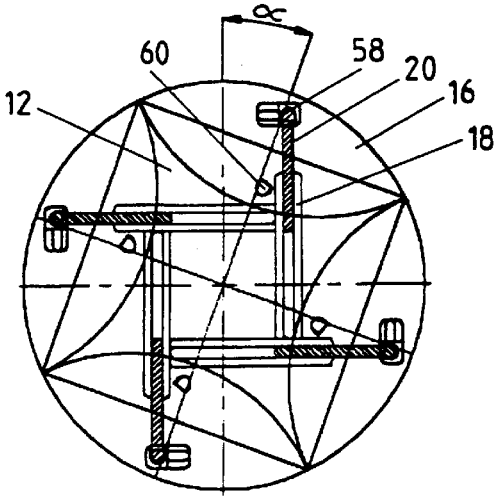
Figure 18:
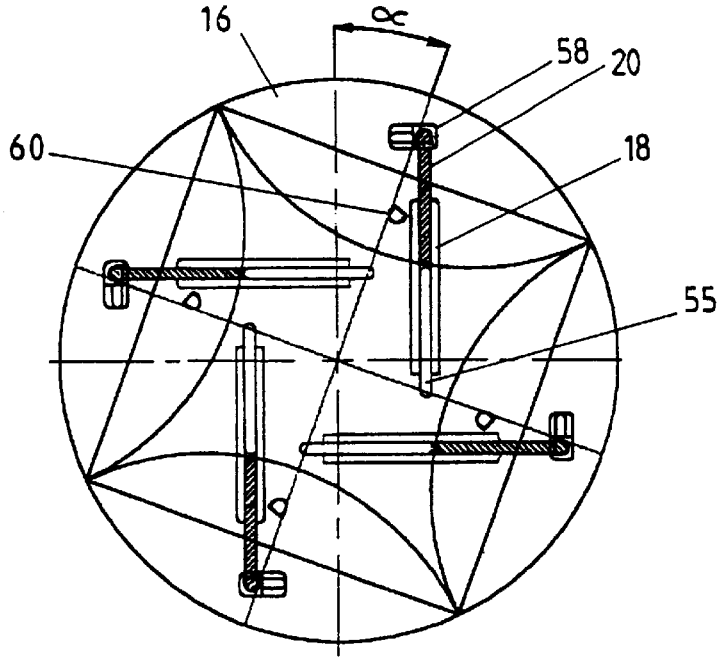
Figure 19:
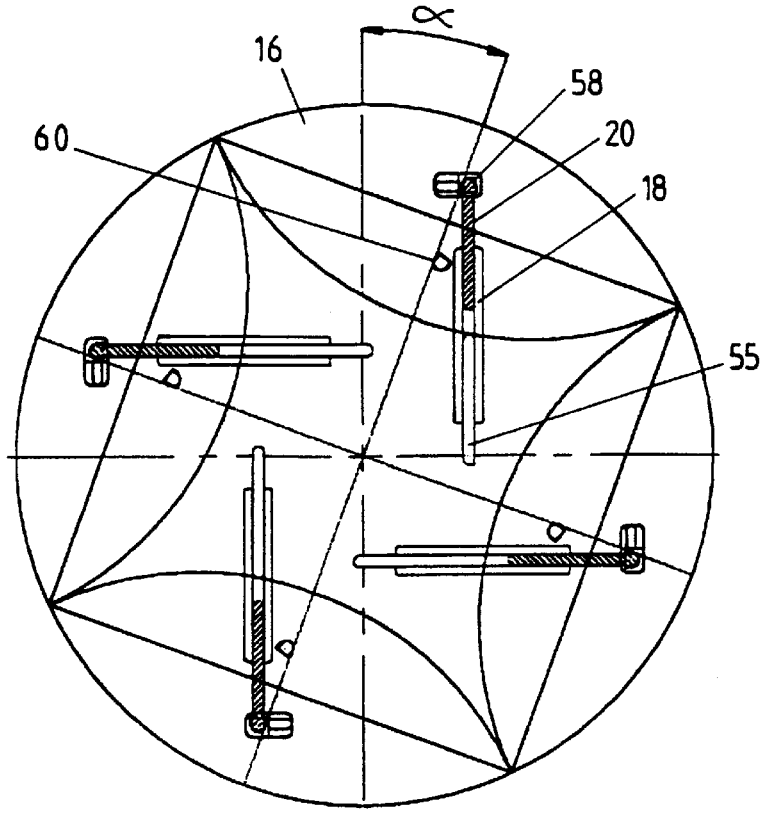

FIGS. 17–19 are bottom plan views of a table system according to the invention fitted with a second embodiment of the supporting mechanism. The tops are of increasing diameters. The rail and sliding members are of constant length in these embodiments.

Figure 20:
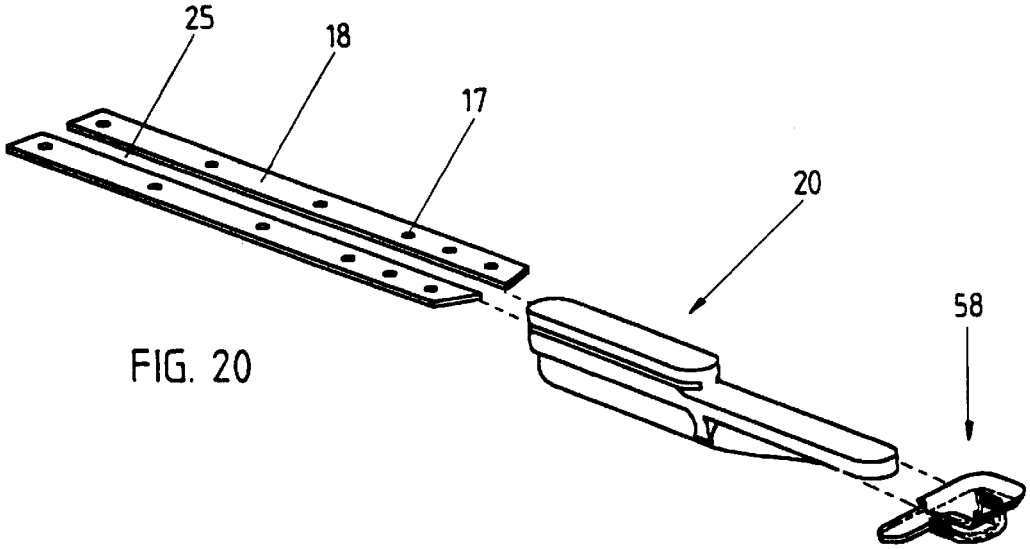

FIG. 20 is an exploded view of a rail member and shoe/friction catch of the second embodiment of the supporting mechanism of the invention.

Figure 21:
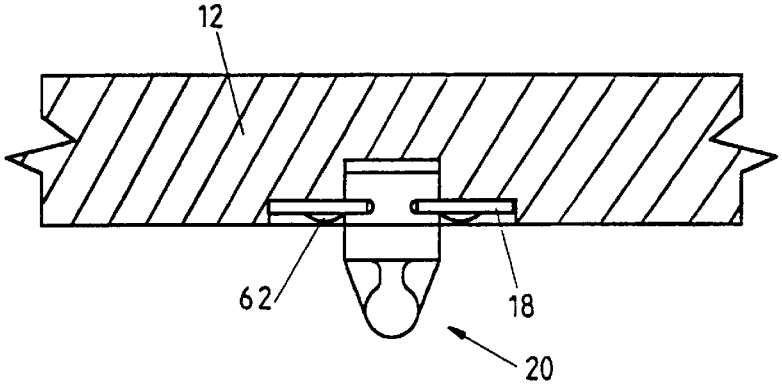

FIG. 21 is a cross-sectional view of the second embodiment of a supporting mechanism mounted to the bottom of a table.

Figure 21A:
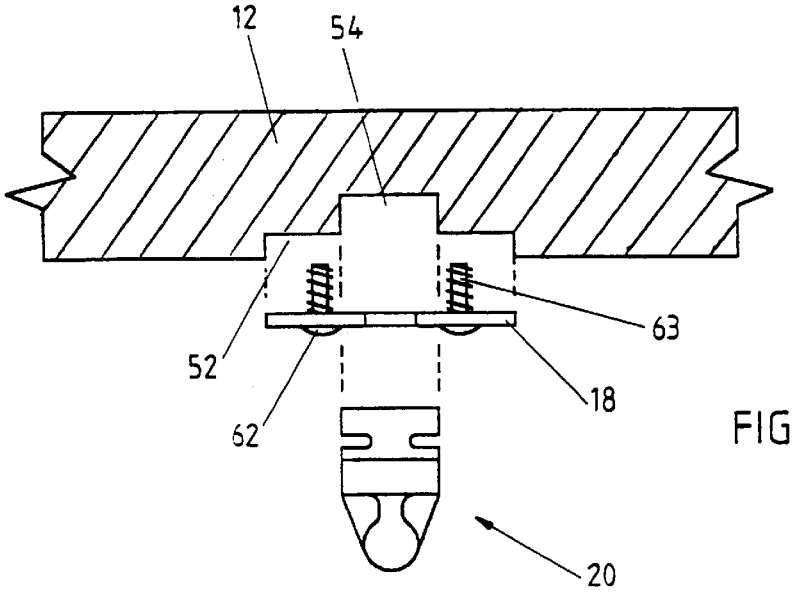

FIG. 21A is an exploded view of FIG. 21.

Figure 22A:
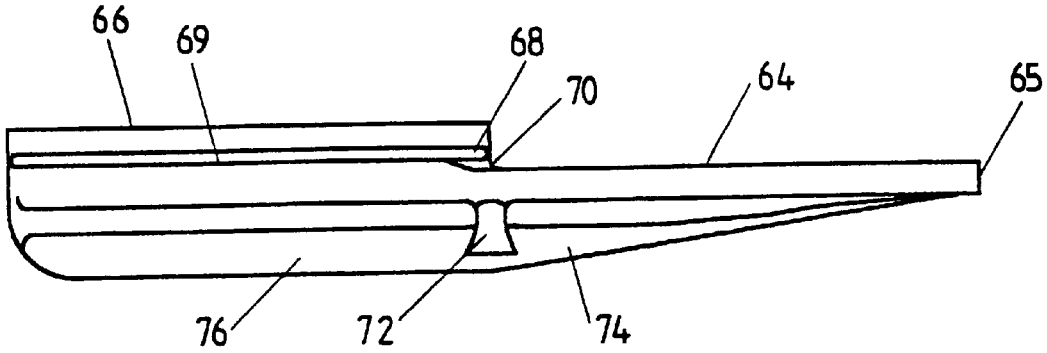
Figure 22B:
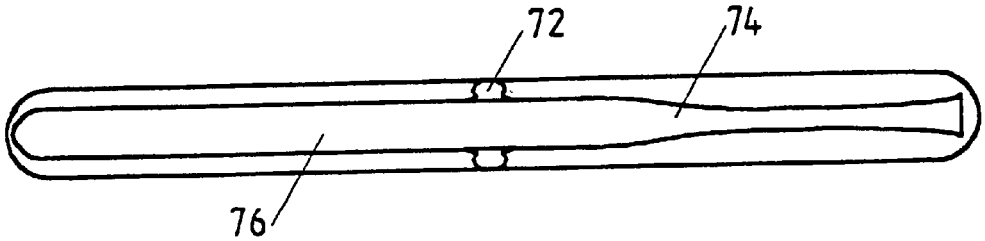
Figure 22C:
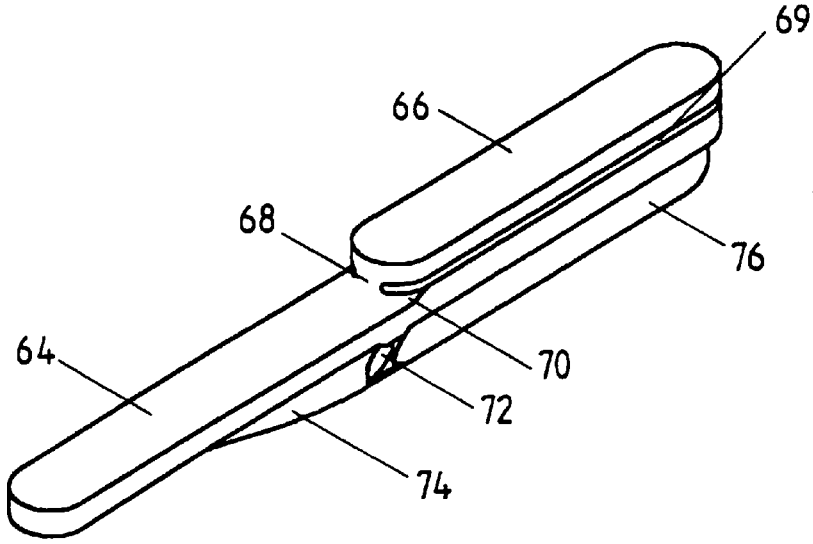

FIGS. 22A, 22B and 22C are respectively a side elevation, a bottom elevation and a perspective view of a sliding member of the second embodiment according to the invention.

Figure 23:
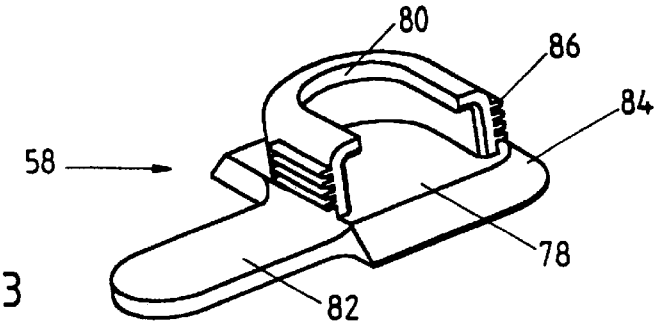

FIG. 23 is a perspective view of a combined shoe/friction catch of the second embodiment of the support mechanism according to the invention.

Figure 24:
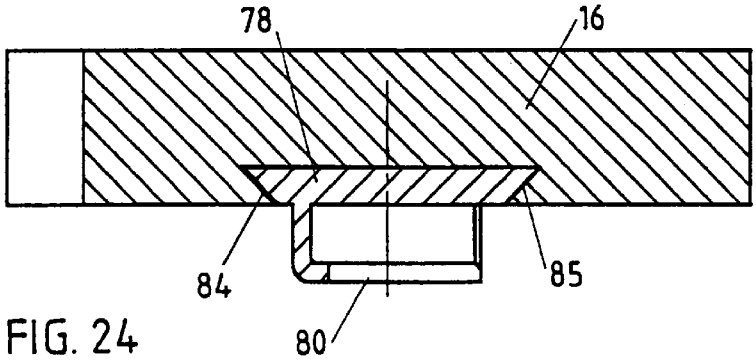
Figure 26:
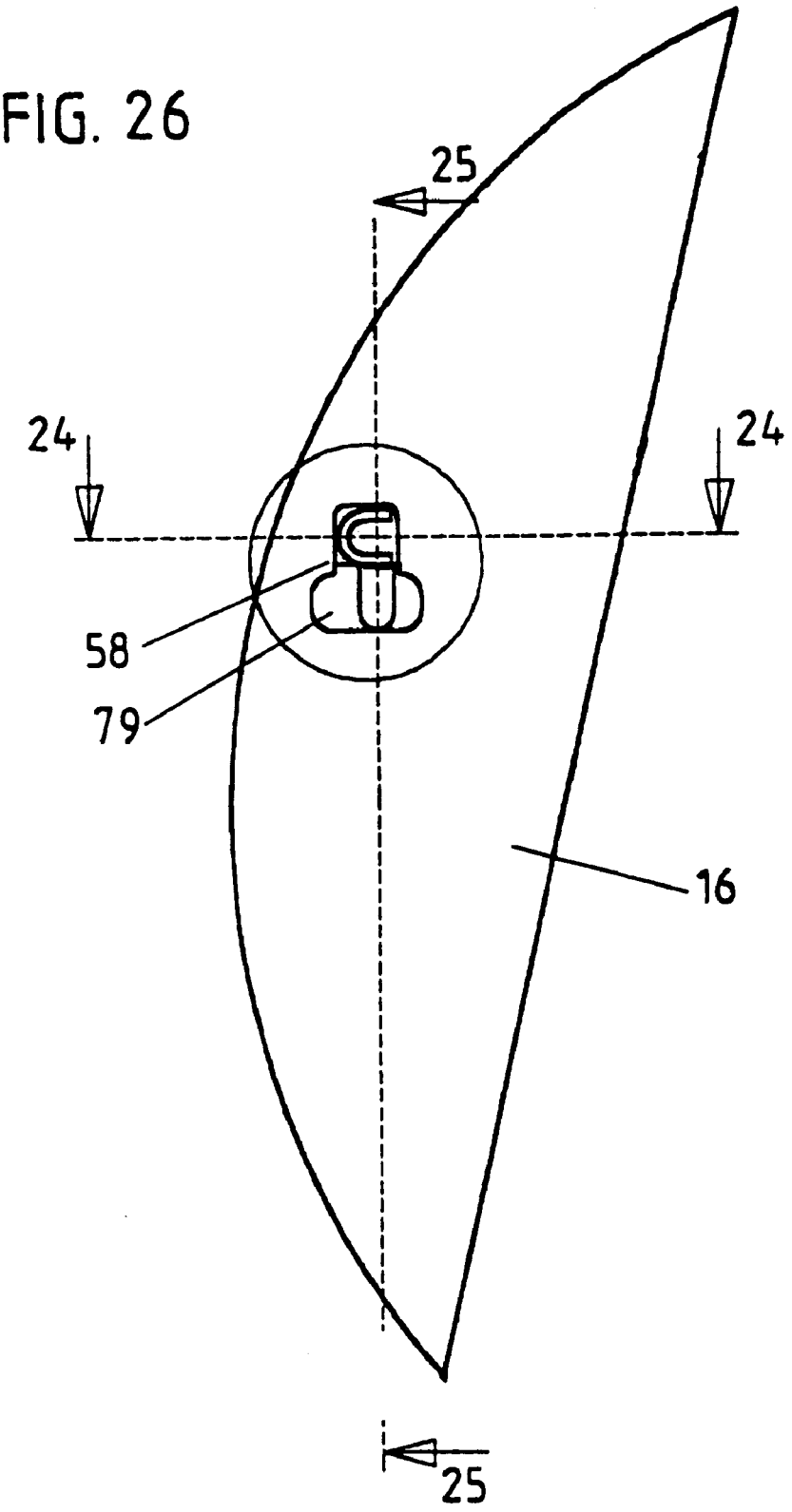

FIG. 24 is the cross-sectional view 24—24 shown in FIG. 26.

Figure 25:
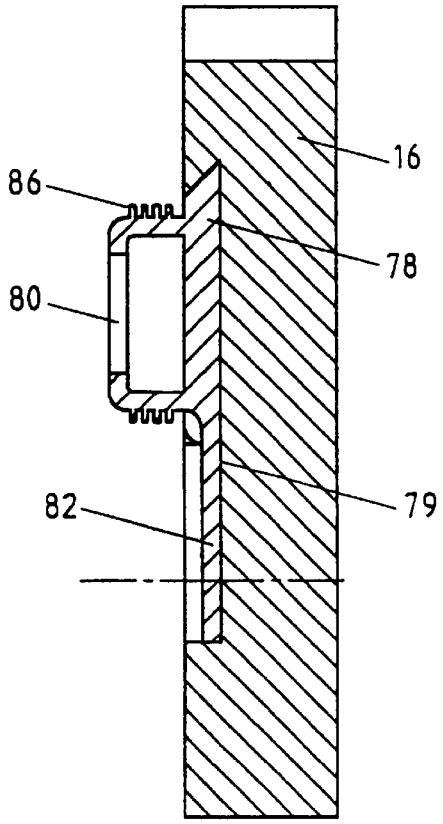

FIG. 25 is the cross-sectional view 25—25 shown in FIG. 26.

FIG. 26 is a bottom plan view showing a shoe/friction catch mechanism 50 on a leaf as shown in FIGS. 17 to 19 but on a larger scale.

MODES OF CARRYING OUT THE INVENTION

Types of Table Systems

Figure 1:
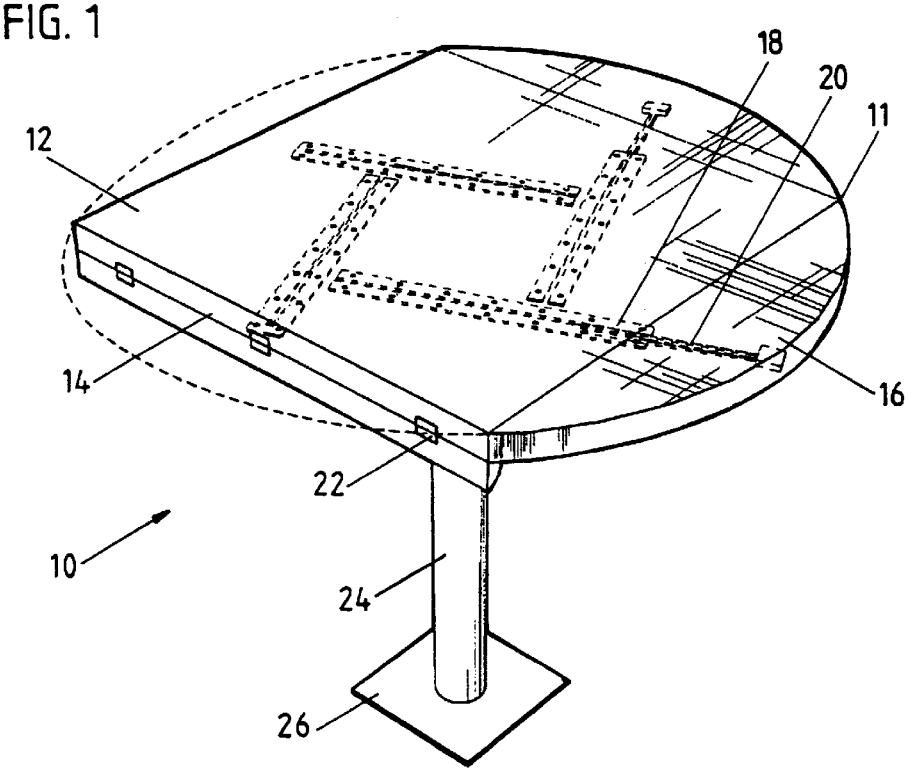
FIG. 1 is a top perspective view of a square table supported by a central pedestal with leaves in the extended position and two in the stored position.
Figure 2:
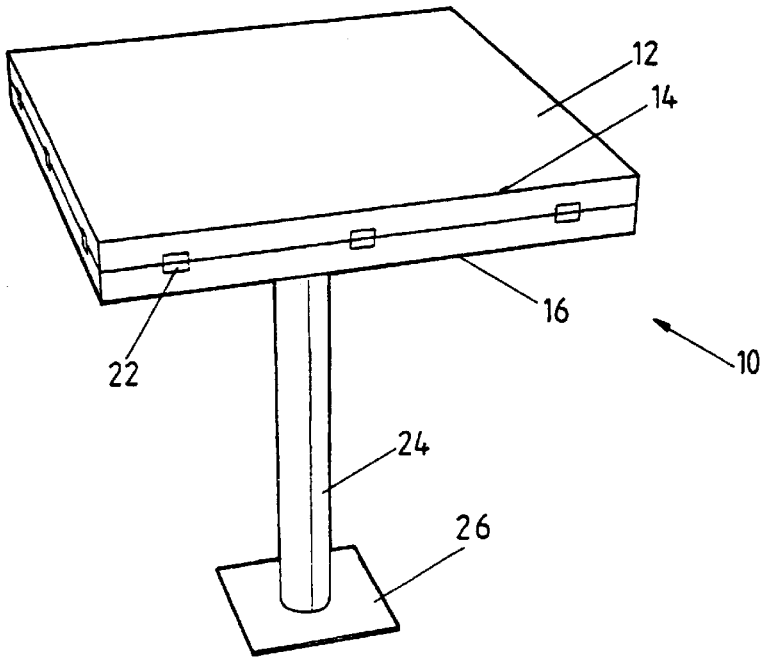
FIG. 2 is a top perspective view of the table of FIG. 1 with all four leaves in the stored position.

A square table according to the invention is illustrated in FIGS. 1 and 2. The table 10 consists of a fixed top portion 12 and four leaves 16. In the embodiment illustrated the edges 14 of the table intersect at corners 11 as do the leaves 16. On edge 14 shown there are three hinges 22 about which leaf 16 pivots. Appropriate hinges will be well known to those skilled in the art. It is preferred to use those of the type illustrated which are substantially flush with the edges when the leaves are in the stored position.

The table illustrated in FIGS. 1 and 2 has a central pedestal 24 on a base 26. Such a table would be typically used in a restaurant or for informal dining in homes or other accommodation.

Figure 3:
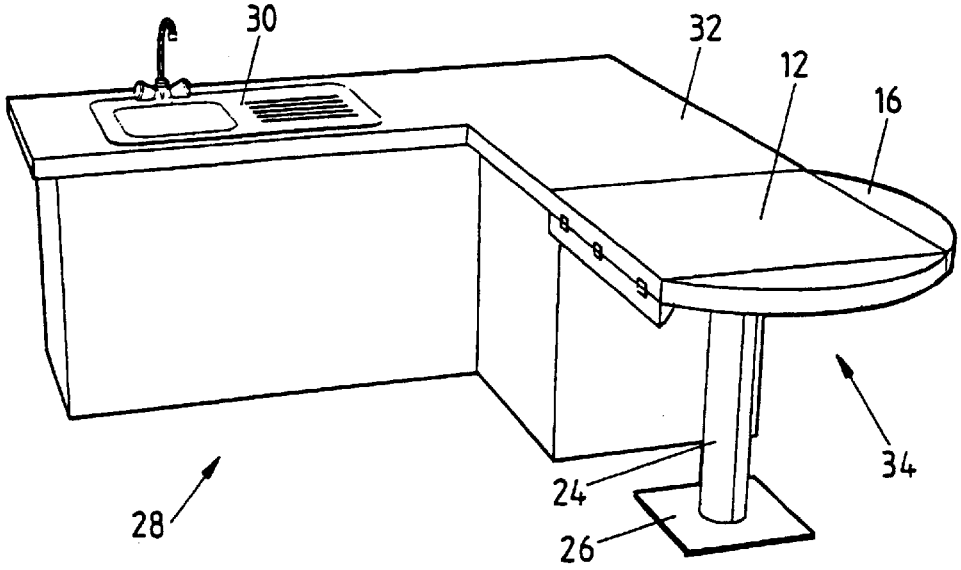
FIG. 3 is a perspective view of a table system according to the invention, in the embodiment of a bench top extension in a kitchen setting.

In FIG. 3 there is illustrated a table system according to the invention installed in a kitchen. A kitchen side board 28 typically has a sink 30 and bench top 32. The fixed top portion 12 of the table system is a bench top extension 34. In this embodiment there are three leaves 16, one of which is stored and the other two of which are in the operative positions. As in the embodiments of FIGS. 1 and 2 there is a central pedestal 24 and a base 26.

Figure 4:
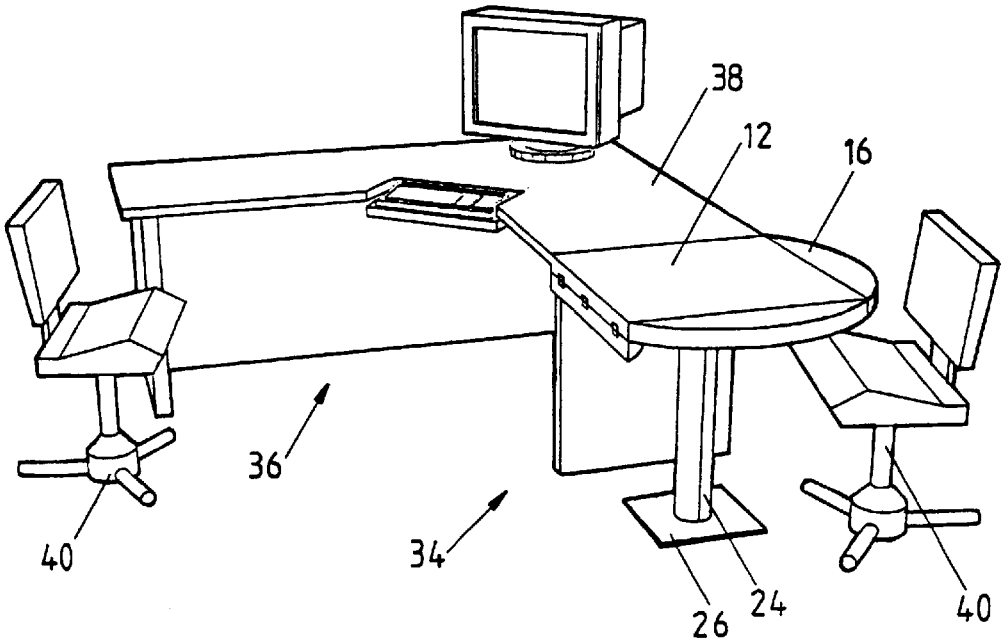
FIG. 4 is a perspective view of a table system according to the invention in the embodiment of a desk extension in an office setting.

The embodiment illustrated in FIG. 4 is a convertible table system according to the invention in an office setting. A desk 36 with desk top 38 and a pair of chairs 40 are illustrated. The desk top extension 34 forms the fixed top section 12 which has three leaves 16. One leaf 16 is shown in the stored position while the other two are in the operative positions. A central pedestal 24 rests on a base 26.

Figure 5:
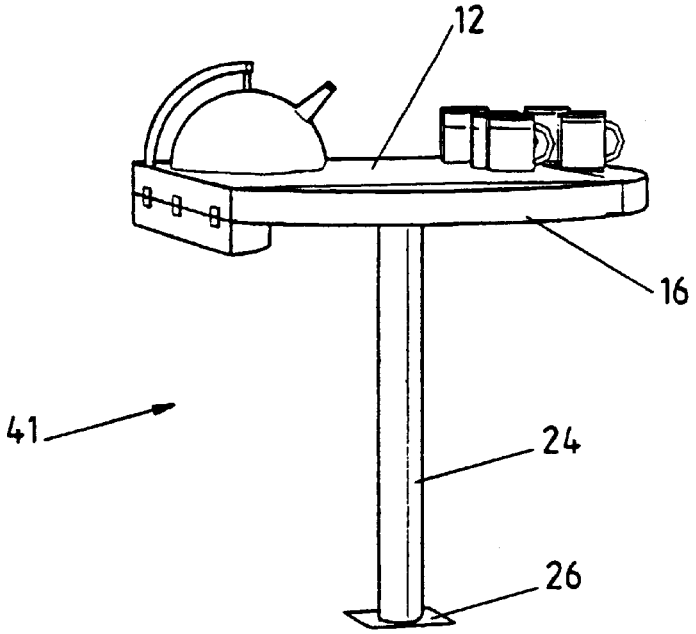
FIG. 5 is a convertible table system according to the invention in the embodiment of the side table.

In FIG. 5 there is illustrated a side table 41 which would be normally used in a domestic setting but could be used as a wall table in a restaurant. In this case the fixed top portion 12 is rectangular. One leaf 16 is in the stored position while the other two are in the operative positions. The table system rests on a central pedestal 24 on a base 26 as in the embodiments of FIGS. 1 to 4.

Figure 6:
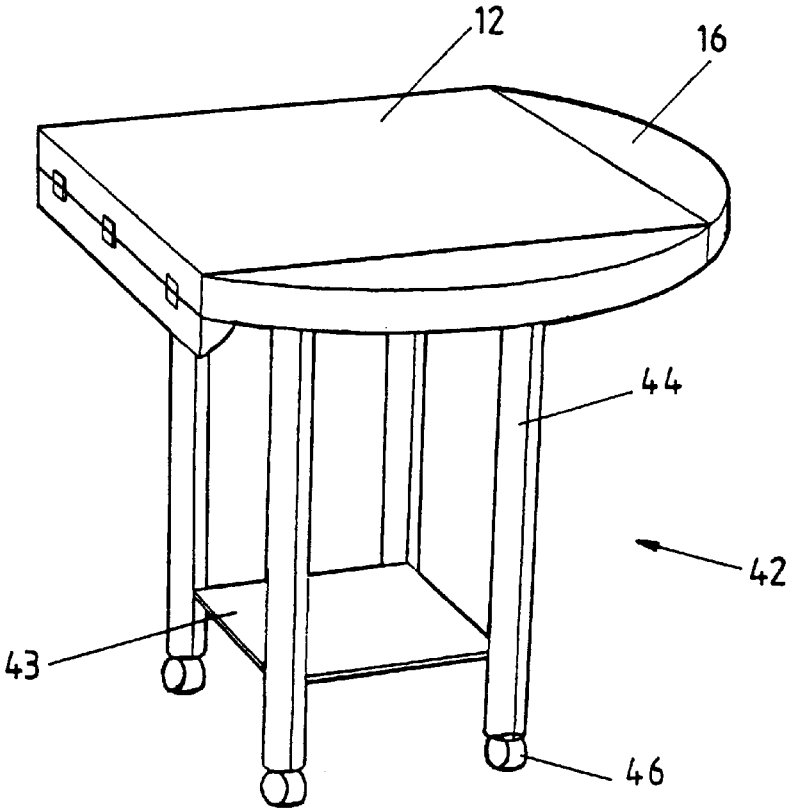
FIG. 6 is a perspective view of a convertible table system according to the invention in the embodiment of the trolley table.

In FIG. 6 there is illustrated a convertible table system according to the invention in the embodiment of a trolley table 42. The fixed top portion 12 and the leaves 16 are identical to those illustrated in FIG. 1. However, in this embodiment there are four legs 44 resting on castors 46 which with shelf 43 complete the trolley construction.

Construction of a First Embodiment of the Supporting Mechanism

The configuration and construction of the supporting mechanism are illustrated in FIGS. 7–16. Each supporting mechanism consists of a rail member 18 and a sliding member 20. As can best be seen in FIG. 9 the rail member is in this embodiment a substantially U shaped member with a gap 25 between two sides. There are a series of screw holes 17 through which screws can be used to mount the rail to the bottom of top portion 12. The sliding member 20 consists of a pendant supporting portion 21, a foot portion 19 and a leg portion 23 (as shown best in FIG. 10A).

The rail member 18 and sliding member 20 can be made out of different materials. For obvious reasons the materials are selected to give long wear and have low friction between them. In a preferred embodiment the rail member is made of metal resistant to corrosion and the sliding member of a sturdy plastic material. The low friction surface of many plastic materials lend themselves to this application. A preferred material is a glass reinforced nylon. Other materials known to those skilled in the art for use for these purposes may be used.

The way in which the rail member and sliding members are mounted to the bottom of fixed top portion 12 is illustrated in FIG. 10A. Recesses 52 and 54 are routed out of the bottom of the fixed top portion 12. The volume of recess 54 is sufficient to accommodate, in a relatively loose fit, foot 19. The gap 25 is sufficient to provide a loose fit for leg 23. The recesses 52 are sufficient to allow rail member 18 to be mounted substantially flush with the bottom surface of fixed top portion 12.

Figure 7:
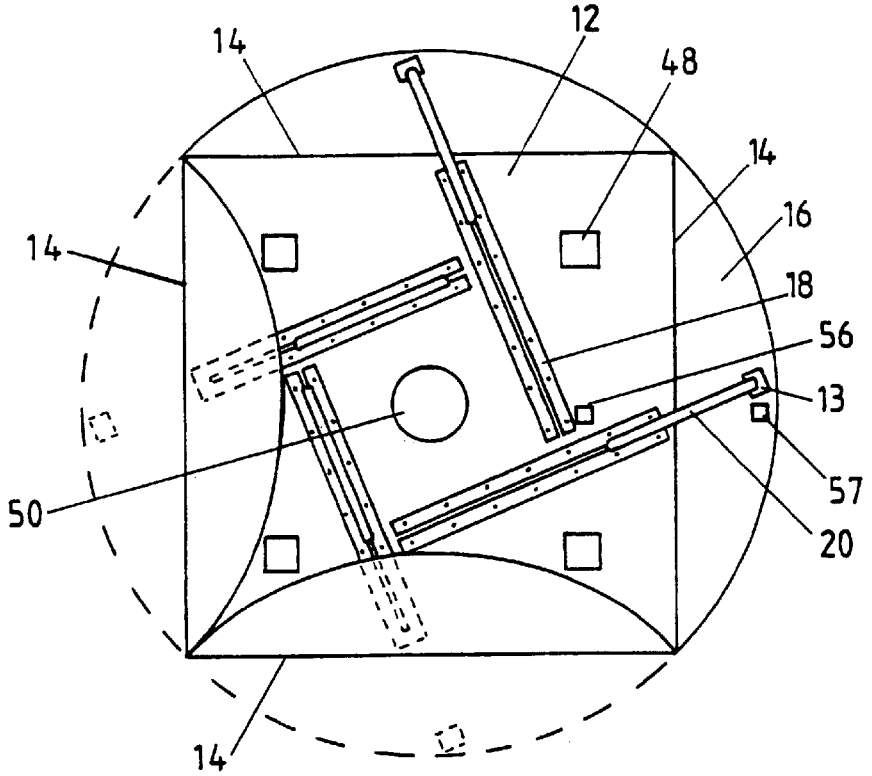
FIG. 7 is a bottom plan view of a first embodiment of the invention with two leaves in the stored position and two in the extended position.
Figure 8:
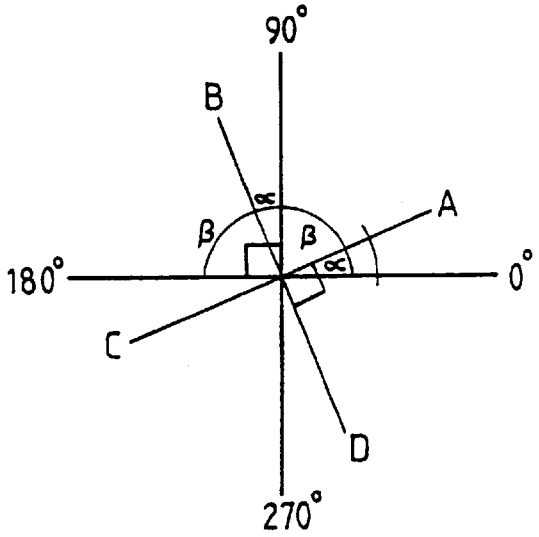
FIG. 8 is a diagrammatic illustration of the alignment of the support means according to the invention.

The important feature of both embodiments of supporting mechanisms described are their alignments on the bottom surface of the fixed top portion 12. The way in which this alignment is made is illustrated in FIGS. 7 and 8. Illustrated in FIG. 8 is a compass. The 0–180° axis is parallel to the top and bottom edges 14 of the table in FIG. 7. The 90°–270° axis is parallel to the side edges 14 illustrated in FIG. 7. The longitudinal axes of the rail members 18 and the sliding members 20 which support each of the left and right leaves 16 in FIG. 7 are parallel to the line A-C in FIG. 8. The longitudinal axes of the rail members 18 and the sliding members 20 supporting the top and bottom leaves 16 in FIG. 7 are parallel to the line B-D.

The preferred angle β (for the first embodiment) between the longitudinal axis of the rail member 18 and the sliding member 20 supporting the right hand leaf 16 in FIG. 7 and side edge 14 is 67.5°. It has been found that the range of angles can be from 67° to 71° can be used.

The advantage of having the longitudinal axis of the rail and sliding means at the angles illustrated is so that the pendant supporting portion 21 of sliding member 20 can extend vertically downwardly to be of sufficiently robust construction to support a leaf 16 resting on it in the conditions commonly encountered in restaurants or public bars. By aligning the rail and sliding means as illustrated the supporting portion 21 can be retracted completely out of the way of a leaf 16 when it is folded flush against the bottom of fixed top portion 12.

Also illustrated on the right hand leaf 16 of FIG. 7 is a wedging member 13. In one embodiment this wedging member 13 serves to bias the leaf 16 into a rigid operative position from which it is difficult to dislodge.

Also illustrated on the right leaf 16 of FIG. 7 are the two parts 56 and 57 of a magnetic catch which retains each leaf 16 in the stored position.

In FIG. 7 there are shown two alternative mounting constructions for the table system. The mounting point 50 is intended to receive a single central pedestal 24. The mounting points 48 are intended to receive four separate legs. These mounting points are also out of the way of both the rails and sliding members 18 and 20 and of the leaves 16 so that the leaves 16 may rest substantially flush against the bottom of top fixed portion 12.

FIGS. 11–16 illustrate the different configurations of the support means of different dimensions of tables. In each case the angle of the longitudinal axis of a rail/sliding member combination with its adjacent edge is 67.5°.

Figure 11:
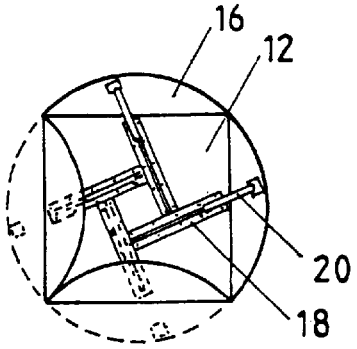
FIGS. 11–16 are bottom plan views identical to that shown in FIG. 7 of square tables according to the invention fitted with a first embodiment of the supporting mechanism. The table tops are of increasing diameters illustrating possible variations in positioning of the support means and lengths of rail and sliding members.
Figure 12:
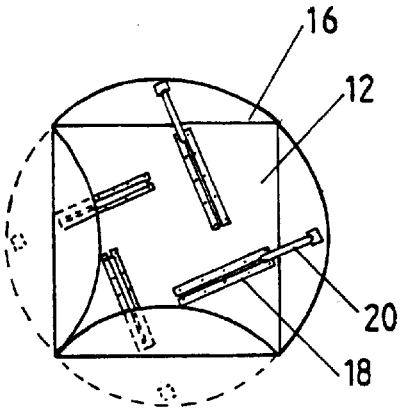
Figure 13:
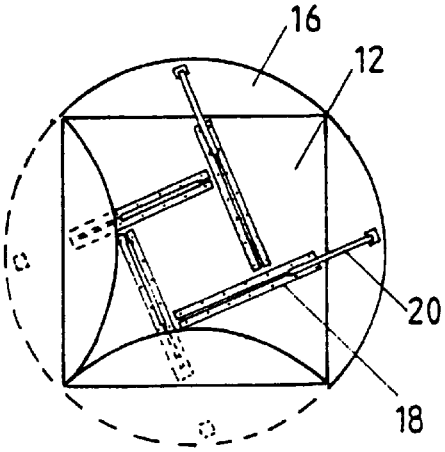
Figure 14:
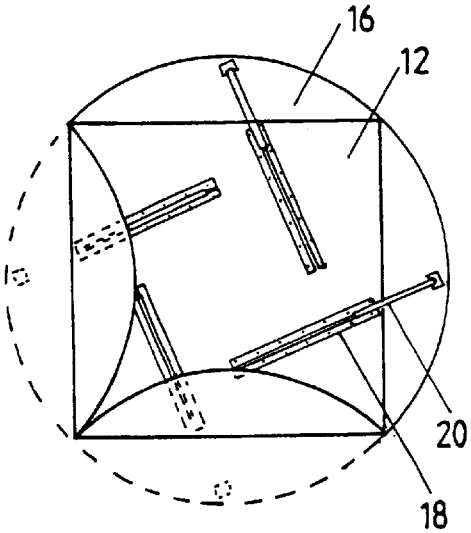
Figure 15:
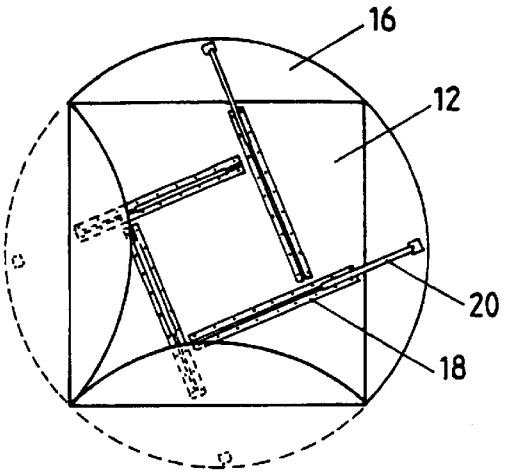
Figure 16:
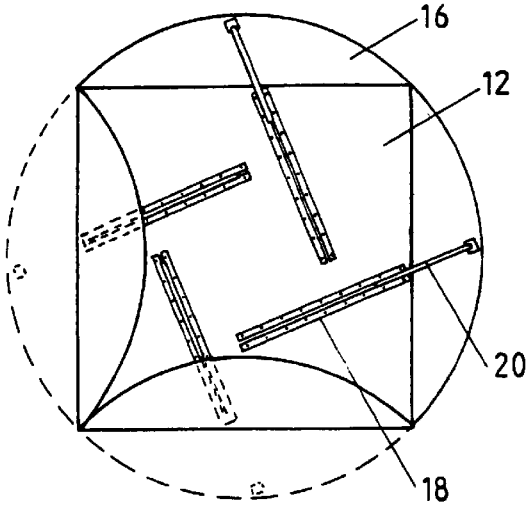

The diameters of the circles of the tables of FIGS. 11–16 are 900 mm, 1100 mm, 1272 mm, 1500 mm, 1600 mm and 1800 mm. The rail members 18 and the sliding members 20 in each of FIGS. 11 and 12 are each of the same lengths. In FIG. 12 the rail members 18 are spread out more from one another than they are in FIG. 11. A second longer set of lengths of rail members 18 and sliding members 20 are used for the embodiments in FIGS. 13 and 14. Finally, a third even longer set of lengths of rail members 18 and sliding members 20 are used in FIGS. 15 and 16.

In each instance the sliding members 20 are able to be extended to be close to the peripheral edge of the leaf 16 which they are supporting.

Operation of First Embodiment

In a typical restaurant setting a table 10 will be in the stored position illustrated in FIG. 2. When a party asks for the table to be expanded to accommodate more guests the staff member reaches underneath the table, releases the magnetic catches 56, 57 of the leaf or leaves 16 which need to be raised and pulls the corresponding sliding member 20 out to the supporting position where it is positioned by wedge member 13.

It is a simple matter to restore the table to a square configuration by reversing the operation just described.

Construction of a Second Embodiment of the Supporting Mechanism

The second embodiment of the supporting mechanism according to the invention is illustrated in FIGS. 17–26. In this embodiment, for the purpose of standardising componentry a single length of rail member 18 and a single length of sliding member 20 is used for each size table. In addition, there is provided a shoe 58 in which to dock a sliding member 20 on each leaf 16. The dock also serves as a friction catch for each leaf when it is folded up under the table as will be explained below.

The tables illustrated in FIGS. 17, 18 and 19 are 920, 1200 and 1500 mm in diameter respectively. In each case there is provided four sets of rail members 18 and four sliding members 20 each of a standard single length. As will be seen in FIGS. 18 and 19 there is routed out of the bottom of fixed top portion 12 a continuation 55 of the sliding member foot recess 54 immediately above each rail member 18. This allows sliding member 20 to be retracted fully away from leaf 16 without having to use longer rail members 18 for the greater diameter tables in FIGS. 18 and 19. It will also be seen that the ends of sliding members 20 do not extend as close to the edges of leaves 16 in the table of FIG. 19 as in that in FIG. 18. Similarly, the ends of the sliding members 20 in the table of FIG. 18 do not extend as close to the edge of leaves 16 as they do in the table of FIG. 17.

Also illustrated is the combined shoe/friction catch member 58. There is a corresponding hole 60 which is routed out of the bottom of fixed top portion 12 to receive catch member 58. This will be described in more detail below.

The angle α near the top of each of FIGS. 17–19 is the same angle a illustrated in FIG. 8. In order to fit the rail members and sliding members into the spaces between the folded leaves 16, the angle α in this second embodiment is 20°. Its complementary angle β is 70°. The angle β is that between the longitudinal axis of each rail and sliding member combination and its adjacent edge 14 as explained above in relation to FIGS. 7 and 8.

Turning to FIG. 20 the rail member 18 in the second embodiment consists of a pair of rails with a gap 25 between them. It will be seen that screw holes 17 are in a greater concentration near the outer end of the rail member 18 which bears the greater load. The sliding member 20 and the shoe/friction catch 58 will be described in more detail below.

The sectional views of this embodiment in FIGS. 21 and 21A are very similar to the cross-sectional views of the first embodiment in FIGS. 10 and 10A. It has been found to the advantageous to use round head screws 63 to retain rail members 18 in place. The rail recess 52 is slightly deeper therefore, so that the screw heads 62 are preferably slightly recessed from the lower surface of fixed top portion 12. The foot recess 54 in fixed top portion 12 is sufficient to accommodate the foot 66 of sliding member 20.

Sliding member 20 is shown in detail in FIGS. 22A, 22B and 22C. The leaf supporting surface 64 has a rounded nose 65. Below surface 64 is a forward reinforcing member 74 which merges with a web 72. To the rear of supporting member 20 is a main reinforcing member 76. The foot 66 of the sliding member 20 has a leg 68 defining the inner surface of grooves 69.

There is a small stepped portion 70 from the front of leg 60 to surface 64. This is to accommodate the screw heads 62 as shown in FIG. 21. Grooves 69 ride on rail members 18 which are slightly elevated above being flush with the bottom surface of fixed top portion 12.

The materials for the rail and sliding members of the second embodiment are chosen using the same selection criteria as for the first embodiment. Sliding member 20 is preferably moulded using glass reinforced nylon. The shapes of the portions described are chosen taking into account the required strength needed at the identified stress points, the ergonomics of the intended use and the moulding considerations.

The shoe/friction catch 58 is illustrated in detail in FIGS. 23–26. A dock 80 sits on a base 78. The nose 65 of supporting member 20 slides into the horse shoe shaped dock 80 and rests on base 78. On the outside of the dock 80 are a series of flexible flutes 86. The base 78 is provided with a bevelled flange 84 extended around three of the sides to key it into position in leaf 16. A tab portion 82 assists in insertion of the shoe/friction catch 58. As will be seen from FIGS. 24lower surface of each leaf 16. The part recess 79 in the lower surface of each leaf 16. The part of the recess 79 which retains the shoe/friction catch 58 has bevelled edges 85 corresponding to the bevelled edges 84 of shoe 58 as can be seen by FIG. 24.

After the routing of recess 79 in the bottom of leaf 16 is completed the shoe 58 is held by the tab 82, pushed to the bottom of the recess 79 and slid into position with bevelled edges 84 of the shoe being keyed into position by the corresponding bevelled edges 85 of the recess 79.

The hole 60 illustrated in each of FIGS. 17–19, which forms the other mating half of the frictional catch, is routed out of the fixed top portion 12 in a substantially D shape. The frictional forces of the flexible flutes 86 against the sides of the hole 60 retain the leaf 16 in the stored position.

Operation of Second Embodiment

The conversion of a table system according to the invention fitted with a second embodiment of a supporting mechanism will now be described. The person seeking to convert the table in the stored position to the extended position would reach under the table and feel for the edge of leaf 16. Grasping the edge of table leaf 16 the person would pull the mated halves of frictional catch apart and pivot the leaf 16 to the extended position. The person erecting the table would then grasp the sliding means 20, conveniently via web 72, and pulling it outwardly until the nose 65 has been extended to be received in dock 80 of shoe 58. In this position the sliding member 20 is protected against being accidentally dislodged. It is also possible to build a slight wedging elevation into base 78 to promote a slight wedging action to more positively lock sliding member into position. The sliding member 20 in this position assists the hinges in bearing the load if the table is lifted by the outer edges of leaves 16 in the erected position.

When the operator wishes to return the leaf 16 to the stored position it is a simple matter of reaching underneath to the sliding member 20, again preferably at web 72 and pushing it backwards until the nose 65 is clear of the edge of leaf 16. The leaf 16 is pivoted until the flutes 86 on catch 58 create the friction catch within hole 60 to retain the flap in the stored condition.

Although the invention has been described in relation to square embodiments it will be appreciated by those skilled in the art that rectangular embodiments may also be used.

Other embodiments of the invention as defined in the appended claims will be apparent to those skilled in the art.

We claim:

1. A table system comprising a fixed top portion having at least one pair of adjacent edges, a leaf cooperable with each said edge, each said leaf being pivotal through substantially 180° from an operative position in which the top surface of said leaf is substantially coplanar with the top surface of said fixed top portion to a storage position in which the bottom surface of said leaf rests against or adjacent the bottom surface of said fixed top portion, support means associated with each said leaf, each said support means comprising a rail member and an associated sliding member, each said rail member being fixed to the bottom surface of said fixed top portion, a supporting portion of each said sliding member extending downwardly from said rail member, each said sliding member being reciprocally slidable with said associated rail member from an extended position in which the supporting portion supports said associated leaf in the operative position to a retracted position in which no part of said supporting portion is between said leaf and said fixed top portion, and means to retain each said leaf in the retracted position.

2. A table system as claimed in claim 1 wherein said rail member is recessed into the bottom surface of said fixed top portion so that no part of said rail member is between said leaf and the bottom surface of said fixed top portion when said leaf is in the stored position.

3. A table system as claimed in claim 1 wherein said adjacent sides of said fixed top portion intersect.

4. A table system as claimed in claim 1 wherein said fixed top portion is square.

5. A table system as claimed in claim 1 wherein said table system is a portion of a desk.

6. A table system as claimed in claim 1 wherein said leaf is substantially a segment of a circle.

7. A table system as claimed in claim 1 wherein said fixed top portion is mounted on a single central pedestal.

8. A table system as claimed in claim 1 wherein said fixed top portion is mounted on four legs.

9. A table system as claimed in claim 1 wherein each said leaf is hingedly connected to one of the edges of said fixed top portion.

10. A table system as claimed in claim 1 wherein said rail member comprises a pair of side members with a gap of therebetween, and said sliding member has a leg section and a foot portion which are substantially T-shaped in cross-section, said foot portion sliding along upper surfaces of said side members with said leg being in the gap therebetween, said supporting portion of said sliding member extending from said leg.

11. A table system as claimed in claim 1 wherein one member of said support means is made of low friction material.

12. A table system as claimed in claim 1 wherein said retaining means to retain each said leaf in said stored position is a magnetic catch.

13. A table system as claimed in claim 1 wherein said retaining means to retain each said leaf in said stored position is a friction catch.

14. A table system as claimed in claim 1 wherein each said sliding member slides within the associated rail member along a longitudinal axis at an angle in the range of 67–71° with the edge of the table.

15. A table system as claimed in claim 14 wherein said angle is 67.5°.

16. A table system as claimed in claim 14 wherein said angle is 70°.

17. A table system as claimed in claim 1 wherein there is provided on a bottom surface of each said leaf a shoe which receives the outward end of the associated sliding member to define a limit of travel, there being a corresponding recess in the bottom surface of said fixed top portion to receive said shoe when said leaf is in the stored position.

18. A table system as claimed in claim 17 wherein said shoe has flexible flutes which engage said recess in the bottom surface of said fixed portion to provide a friction catch.

* * * * *